US009227105B2

(12) United States Patent
Ehmann et al.

(10) Patent No.: US 9,227,105 B2
(45) Date of Patent: Jan. 5, 2016

(54) EXERCISE DEVICE

(71) Applicants: Ryan J. Ehmann, Mead, CO (US); Shawn R. Alstad, Peoria, AZ (US)

(72) Inventors: Ryan J. Ehmann, Mead, CO (US); Shawn R. Alstad, Peoria, AZ (US)

( * ) Notice: Subject to any disclaimer, the term of this patent is extended or adjusted under 35 U.S.C. 154(b) by 190 days.

(21) Appl. No.: 13/844,008

(22) Filed: Mar. 15, 2013

(65) Prior Publication Data

US 2013/0217550 A1 Aug. 22, 2013

Related U.S. Application Data

(63) Continuation-in-part of application No. 12/855,520, filed on Aug. 12, 2010, now Pat. No. 8,465,402.

(60) Provisional application No. 61/233,759, filed on Aug. 13, 2009, provisional application No. 61/665,262, filed on Jun. 27, 2012.

(51) Int. Cl.

| | |
|---|---|
| ***A63B 22/20*** | (2006.01) |
| ***A63B 23/035*** | (2006.01) |
| ***A63B 21/04*** | (2006.01) |
| ***A63B 21/055*** | (2006.01) |
| ***A63B 21/068*** | (2006.01) |
| ***A63B 21/00*** | (2006.01) |
| ***A63B 23/04*** | (2006.01) |
| *A63B 21/06* | (2006.01) |
| *A63B 22/00* | (2006.01) |

(52) U.S. Cl.

CPC ..... *A63B 23/03575* (2013.01); *A63B 21/0428* (2013.01); *A63B 21/0442* (2013.01); *A63B 21/0552* (2013.01); *A63B 21/068* (2013.01); *A63B 21/143* (2013.01); *A63B 21/1488* (2013.01); *A63B 22/20* (2013.01); *A63B 22/205* (2013.01); *A63B 23/03525* (2013.01); *A63B 23/03541* (2013.01); *A63B 23/0417* (2013.01); *A63B 21/0611* (2013.01); *A63B 2022/0028* (2013.01); *A63B 2022/206* (2013.01); *A63B 2208/0233* (2013.01); *A63B 2209/02* (2013.01); *A63B 2209/10* (2013.01); *A63B 2210/50* (2013.01); *Y10T 29/49826* (2015.01)

(58) Field of Classification Search

CPC ..... A63B 2022/0028; A63B 2022/206; A63B 21/0428; A63B 21/0442; A63B 21/0552; A63B 21/0611; A63B 21/068; A63B 21/143; A63B 21/1488; A63B 2208/0233; A63B 2209/02; A63B 2209/10; A63B 2210/50; A63B 22/20; A63B 22/205

See application file for complete search history.

(56) References Cited

U.S. PATENT DOCUMENTS

| | | | | |
|---|---|---|---|---|
| 3,583,322 | A * | 6/1971 | Vykukal | 104/307 |
| 4,645,201 | A * | 2/1987 | Evans | 482/70 |
| 4,650,184 | A * | 3/1987 | Brebner | 482/71 |

(Continued)

*Primary Examiner* — Stephen Crow

(74) *Attorney, Agent, or Firm* — Griffiths & Seaton PLLC

(57) ABSTRACT

An exercise device is provided that includes a trolley. The trolley includes two vertical plates, wheels, and at least one foot locking device connected to the trolley, the at least one foot locking device adapted to make contact with at least a portion of a foot of the user. A shaft is provided having a first end and a second end. A flexible mechanism comprising a portion of the shaft placed in a position of the shaft between the first end and the second end for allowing at least one portion of the shaft to move and rotate. The shaft accommodates the trolley. The trolley is adapted to be pulled along the shaft by the least one foot locking device while the user is in a seated position. A substantially planar surface is provided with a top surface connected to the second end of the shaft.

18 Claims, 15 Drawing Sheets

(56) References Cited

U.S. PATENT DOCUMENTS

| | | | | | |
|---|---|---|---|---|---|
| 4,813,667 | A * | 3/1989 | Watterson | 482/70 |
| 5,029,848 | A * | 7/1991 | Sleamaker | 482/96 |
| 5,354,251 | A * | 10/1994 | Sleamaker | 482/96 |
| 5,499,961 | A * | 3/1996 | Mattox | 482/132 |
| 5,827,158 | A * | 10/1998 | Drecksel | 482/96 |
| 5,921,900 | A * | 7/1999 | Mankovitz | 482/121 |
| 6,001,051 | A * | 12/1999 | Chuan-Pin | 482/131 |
| 6,071,217 | A * | 6/2000 | Barnett | 482/121 |
| 6,488,614 | B1 * | 12/2002 | Chang | 482/110 |
| 6,500,105 | B1 * | 12/2002 | Kuo | 482/123 |
| 6,811,517 | B1 * | 11/2004 | Eschenbach | 482/52 |
| 6,890,288 | B2 * | 5/2005 | Bingham | 482/69 |
| 7,115,079 | B2 * | 10/2006 | Yu | 482/126 |
| 7,204,790 | B2 * | 4/2007 | Sleamaker | 482/96 |
| 7,462,138 | B2 * | 12/2008 | Shetty et al. | 482/69 |
| D584,367 | S * | 1/2009 | Augustine et al. | D21/662 |
| 7,556,592 | B2 * | 7/2009 | Nizam | 482/70 |
| 7,645,218 | B2 * | 1/2010 | Potok | 482/141 |
| 7,682,294 | B2 * | 3/2010 | Piane, Jr. | 482/97 |
| 7,780,585 | B1 * | 8/2010 | Rivas | 482/140 |
| 7,811,215 | B2 * | 10/2010 | Wallach | 482/130 |
| 7,883,450 | B2 * | 2/2011 | Hidler | 482/69 |
| 7,993,248 | B1 * | 8/2011 | Rasmussen | 482/69 |
| 7,998,038 | B2 * | 8/2011 | Keiser | 482/112 |
| D659,777 | S * | 5/2012 | Watterson et al. | D21/689 |
| 8,241,186 | B2 * | 8/2012 | Brodess et al. | 482/52 |
| 8,608,630 | B2 * | 12/2013 | Wu | 482/126 |
| 2006/0183606 | A1 * | 8/2006 | Parmater | 482/72 |
| 2008/0242519 | A1 * | 10/2008 | Parmater | 482/72 |
| 2012/0094812 | A1 * | 4/2012 | Smiley | 482/128 |

* cited by examiner

EXERCISE DEVICE

CROSS-REFERENCE TO RELATED APPLICATION

This non-provisional application is a continuation in part, and claims priority to U.S. application Ser. No. 12/855,520 filed Aug. 12, 2010, now Published U.S. Application 2011/0039666 A1, which is a non-provisional application of provisional application 61/233,759 filed on Aug. 13, 2009, and also claims priority to U.S. Provisional Application 61/665,262 filed on Jun. 27, 2012, the entire contents of which are incorporated herein by reference and is relied upon for claiming the benefit of priority.

BACKGROUND OF THE INVENTION

1. Field of the Invention

The present invention relates in general to an exercise device, and more particularly to an exercise device with a trolley device for exercising the legs and upper body.

2. Description of the Prior Art

Exercise equipment is utilized in today's society for the enhancement and improvement of muscular strength, endurance, and overall physical and mental health. Many exercise devices, such as free weights, barbells, and dumbbells, are bulky and expensive. Failure to properly perform the intended exercise with these devices can result in significant injuries to the novice or inexperienced user. Over the years, progressive improvements to exercise equipment circumvent many of these dangers but often times are bulky, costly, and of great height. Other exercise devices require fixed and permanent installation absent any options for simple storage.

SUMMARY OF THE INVENTION

The focus of an exercise device should provide protection to the user, as well as providing a safe and trouble free operation. The present invention is an improved exercise device designed to be simple and easy for all users.

In view of the foregoing, a need exists for an exercise device having a trolley that is safe to use, easy to store, cost effective, and is transportable. Accordingly, various device and method embodiments for an exercise device are provided. In one embodiment, by way of example only, an exercise device is provided. In one such embodiment, the exercise device includes a trolley. The trolley includes at least two vertical plates with a first and a second side, at least three wheels with a first and a second end, the first and the second end of the at least three wheels being connected to the at least two vertical plates, and at least one foot locking device connected to the trolley, the at least one foot locking device adapted to make contact with at least a portion of a foot of the user. A shaft is provided having a first end and a second end. A flexible mechanism comprising a portion of the shaft placed in a position of the shaft between the first end and the second end for allowing at least one portion of the shaft to move and rotate in a variety of motions and angles. The shaft accommodates the trolley. The trolley is adapted to be pulled along the shaft by the least one foot locking device while the user is in a seated position; and a substantially planar surface with a top surface connected to the second end of the shaft for seating the user in the seated position. Related device and method embodiments are also disclosed and provide additional advantages.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
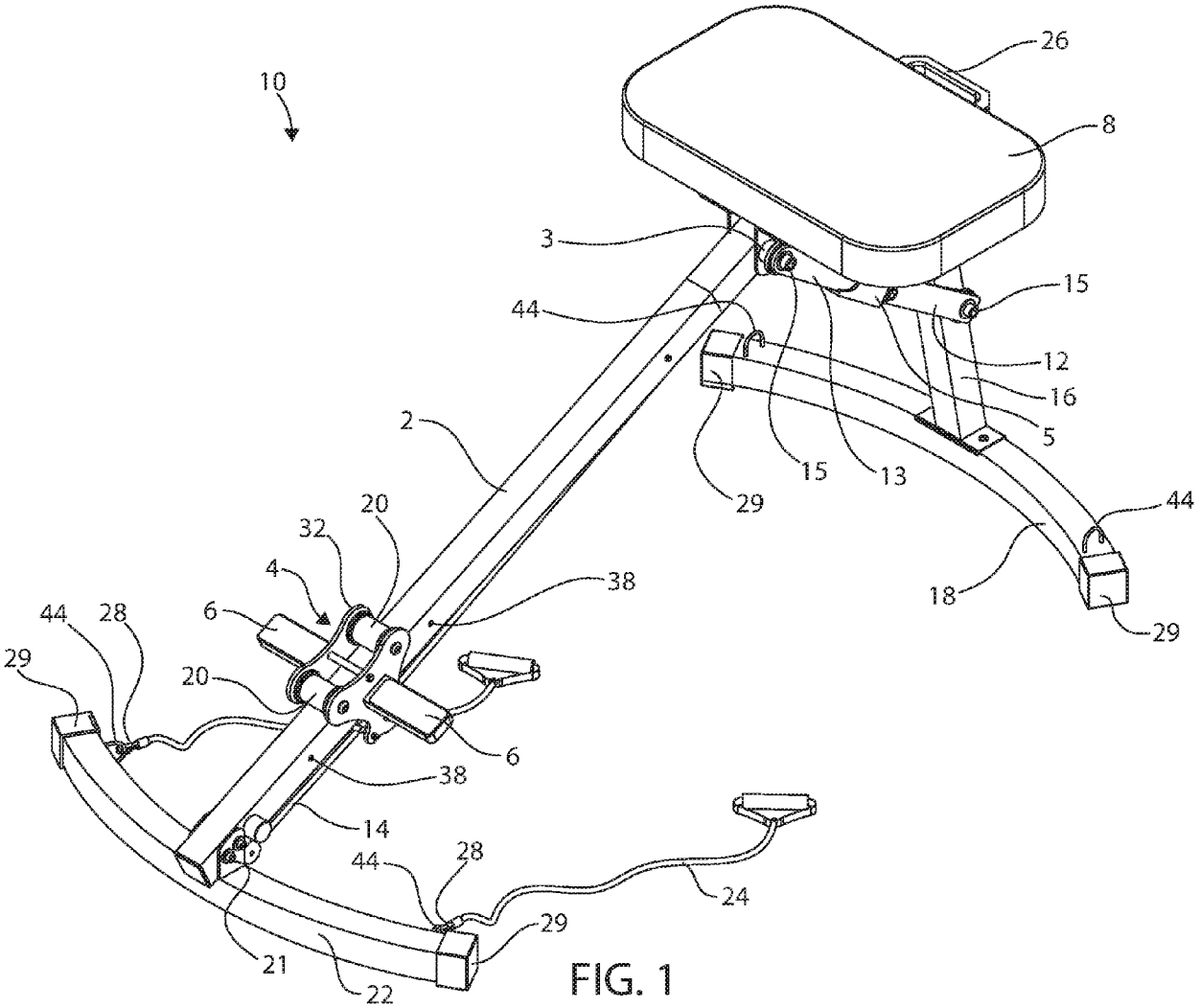
FIG. 1 illustrates an exemplary exercise device according to the present invention from a three dimensional side view.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

In one embodiment, as described herein, a user is allowed to sit on a seat apparatus which may be placed on a supporting, load bearing structure device (e.g., furniture, table, chair, couch, platform, and the like) or even a floor for supporting the exercise device. The user uses the upper and lower body to rotate and/or translate an exercise device simultaneously through many different degrees or freedom and/or motion/angles. A shaft and/or flexible mechanism may rotate up, rotate down, swing left, swing right, rotate clockwise, rotate counterclockwise, translate forward, and/or translate aft. All motions may be accomplished simultaneously, without the user leaving the seated portion of the exercise device and/or adjusting anything on the machine. The machine may be set on a couch, chair, bed, or any suitable load bearing structure to provide an incline of the exercise device for the machine. The exercise device, via the shaft, trolley, foot locking devices, pedals, pegs, hooks, or other embodiments on the exercise device, may allow for at least one weight and/or flexible resistant type cords (e.g., bungee cords) to be secured and/or attached for interchangeable, variable, and/or non-existent resistance. The exercise device may have multiple attachment points for upper body attachments as well (e.g., ability to attach shock cords to work upper and lower body simultaneously). The shaft and/or flexible mechanism may attach to the seat and/or other components (e.g., foot locking devices, foot base, supporting platform, trolley, and the like) via one of many connection type devices or methods, including but not limited to, pegs, screws, joints, and gimbal design, etc., for assisting with securing the device to each component and/or for allowing one or more portions of the exercise device to rotate and/or translate an exercise device simultaneously through many different degrees or freedom and/or motion/angles.

Referring to FIG. 1, showing a three-dimensional side view, is a depiction of one example of an exercise device 10. The exercise device 10 may be composed of steel, iron, a high-strength lightweight alloy material, any metallic material, polyvinyl chloride (PVC) material, polyurethane material, a composite material such as a carbon fiber layup, polymer, a joint metallic and polyurethane material, or any other material known in the art suitable for such an application. One useful option for the composition of the exercise machine 10 may, for example, include carbon steel.

The shaft 2 is the central piece and backbone for strength, stability, and durability for the exercise device 10. The shaft 2 is connected to a front foot 22, a seat 8, a rear beam 16, and a collapsible beam 9 as shown. The shaft 2, front foot 22, rear foot 18, or the rear beam 16 may be of a variety of lengths, shapes and sizes, depending upon the users needs. One useful option for the shaft 2 may include either a straight or curved shaft with very strong and rigid 1.50"×1.50" inch square steel tubing resistant to the wear and tear of the motion of the trolley 4.

In one embodiment, the seat 8 may be a large, stable, and comfortable seat 8, semi-permanently or permanently connected to the rear end of the shaft 2. The seat 8 may be of any type of rubber, plastic, foam, fibrous substance, cloth, synthetic material, or any other type of material known in the art, which are suitable for such an application.

In one embodiment, the shaft 2 has a front end and a rear end. The front end is attached via a connection device 21 to a front foot 22 for stability and stabilization. The connection device 21 may include angled brackets, mounting clamps, or other type of connection devices known in the art for attaching structures together, and may be a separate component or as a permanent structure to either the shaft 2 or the front foot 22.

In one embodiment, the exercise device 10 allows the trolley 4 to roll along the shaft 2 in a forward, backward, upward, downward, or any other directional motion. The trolley 4 consists of a peg 6 connected to the vertical plates 32. Multiple pegs 6 may connect to the trolley 4. The trolley 4 may include adding additional free or external weights to the peg 6. Each of the vertical plates 32 is placed on opposite sides of the shaft 2. The wheels 20 of the trolley 4 are connected to each of the vertical plates 32. One useful option may include two wheels 20 connected to upper portion of the vertical plates 32. The trolley 4 third wheels 20 may connect to each of the lower portion of the vertical plates 32 and be underneath the shaft 2. The two top wheels 20 of the trolley 4 may span the width of the shaft 2 and roll along the top of the shaft 2. The third wheels 20 of the trolley 4, located on the lower portion of the vertical plates 32, may also span the width of the shaft 2 but may or may not come in contact and roll along the shaft 2. The shaft 2 includes various openings 38 allowing for the use of a ball lock pin, or other device commonly known in the art, allowing the trolley 4 to be positioned along the shaft 2 in various locations to accommodate various users' leg lengths. The various openings 38 may be placed throughout the shaft 2 and may include multiple various openings 38.

In one embodiment, the peg 6 allows the user to place on, beneath, inside, above, or securely fix the users feet to the peg 6 to pull the trolley 4 along the shaft. The peg 6 may include attachment devices, such as Velcro®, straps, pedals, or other devices to fix to users feet onto the peg 6. One useful option may include the shaft 2 angled upwards towards the user, and with the users feet on the peg 6 of the trolley 4, pull the trolley 4 along the shaft 2 upwards along the shaft 2 until the shaft 2 reaches a desired ending position or the top of the shaft 2. Once the trolley 4 is at the peak or furthest closest position to the user, the trolley 4 may stop and roll down the angled shaft 2 to the original starting position for another repetition. For example, the trolley 4 may roll down the shaft by gravity, the flexible cord 14, the users feet, or a combination of gravity, the flexible cord 14, and the users feet.

In one embodiment, the rear end of the shaft 2 is connected, by a bolt 15, to the seat 8 and the collapsible beam 9. The bolt 15 may include any connective means such as a bolt, nail, screw, pin, rod, or other device commonly used in the art for connection. The collapsible beam 9 contains both an upper collapsible beam 13 and a lower collapsible beam 12. The upper collapsible beam 13 connects to the shaft 2 while the lower collapsible beam 12 connects to the rear beam 16. The collapsible beam 9 may either be designed as one singular piece, or the collapsible beam 9 may centrally connect two separate attachment pieces, by means of the bolt 15 located in the center of the collapsible beam 9, so as to allow the collapsible beam 9 to pivot, extend, and collapse. Either as a singular piece or two separate pieces, the collapsible beam 9 may pivot, extend, or collapse. A slider 5 is a mechanism used to lock the collapsible beam 9 when the machine is in a set up, a ready, or an upright position. The slider 5 is capable of sliding along the collapsible beam 9. The slider 5 may be a coupling device or housing device that surrounds the collapsible beam 9. When the slider 5 is over the bolt 15 in a locked position, the collapsible beam 9 is unable to pivot, bend, or collapse. In other words, when the collapsible beam 9 is in a substantially straightened position, the slider 5 may slide along the collapsible beam 9 and be set to a locked position over the bolt 15, which is located in the center of the collapsible beam 9. The locked position of the slider 5 allows the user to be in a seated position on the exercise device 10 with the shaft 2 in an angled position and the rear beam 16 in an upright position to stabilize and support the exercise device 10.

Hooks 28 are attached to rings 44, which are secured to the front foot 22 and rear foot 18. The hooks 28 attach to the rings 44 providing the option for flexible hand held cords 24 to be used by the user's hands for additional support, resistance, stability, exercise or other various needs for using the exercise device 10. Additional features, as described in earlier figures, are also depicted as illustrated examples.

Turning to FIG. 2, in one embodiment, again the exercise device includes a shaft 2 with a trolley 4 for rolling along the shaft 2. The rear or right end of the shaft 2 is connected to the seat 8 and the collapsible beam 9 by a bolt 15. The collapsible beam 9 contains both an upper collapsible beam 13 and a lower collapsible beam 12. The upper collapsible beam 13 connects to the shaft 2 and the lower collapsible beam 12 connects to the rear beam 16. The collapsible beam 9 may either be one piece or the collapsible beam 9 may centrally connect two separate attachment pieces, by means of the bolt 15, the bolt 15 being any connective means such as a bolt, nail, screw, pin, rod, or other device commonly used in the art for connection, so as to allow the collapsible beam 9 to pivot, extend, and collapse. The shaft 2 has a front or left end where the shaft 2 connects to the front foot 22 by a connection device 21.

Figure 2:
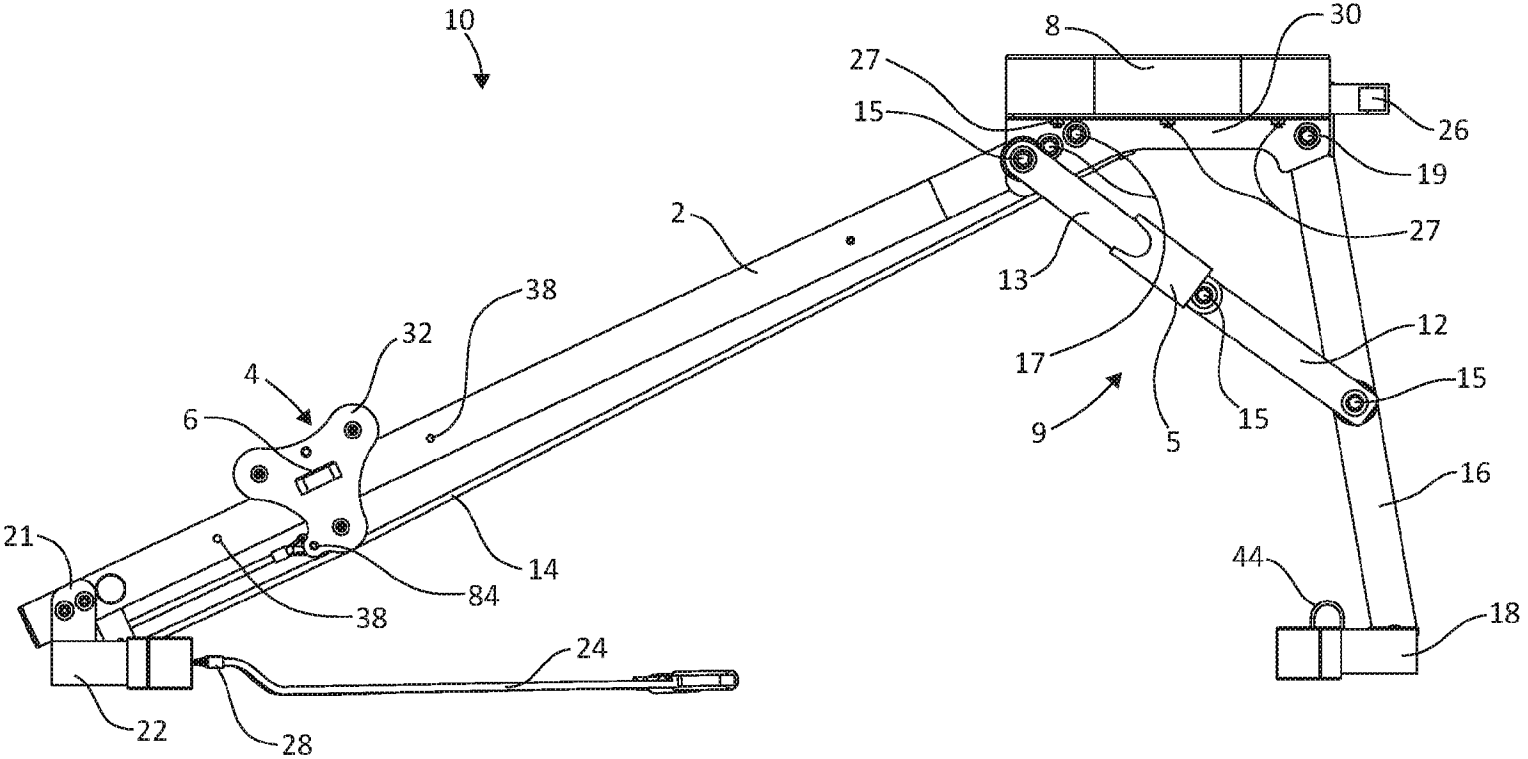
FIG. 2 illustrates an exemplary exercise device according to the present invention from a side view.

More clearly depicted in FIG. 2, is one example of several bolts 27 connecting the seat 8 to the attachment pieces 30 which connect to the shaft 2, the bolts 27 may be any connective means such as a bolt, nail, screw, pin, adhesive, or other device commonly used in the art for such connective purposes.

The front foot 22 may contain end caps 29 on each end to further provide security, stabilization, and protection of the exercise device 10. More clearly depicted is the flexible cord 14, which connects to the trolley 4. The flexible cord 14 may connect directly to either one or both of the vertical plates 32 or a connective pin 84 that is connected to the lower half of the vertical plates 32. One useful option provides for the connective pin 84 device to connect to the lower half of each of the vertical plates 32. The connective pin 84 may span the width, beneath the lower half, of the shaft 2. The exercise device 10 enables the user to select multiple flexible cords 14 or a single flexible cord 14 for resistance to vary the trolley 4 speed, resistance, stroke, and position. The flexible cord 14 is connected to a pulley 25 just underneath the shaft 2 near the connecting device 21. The flexible cord 14 rotates around the pulley 25 and travels back towards the right end of the shaft 2 to connect to the shaft 2 just underneath the shaft 2 and the seat 8. The flexible cord 14 may also use the lower wheels 20 of the trolley 4 as an additional pulley. Depending upon the amount of weight the trolley 4 supports, a slight gap between the bottom of the shaft 2 and the lower wheels 20 of the trolley 2 may exist. The lower wheels 20 of the trolley 4 may work also as an additional pulley for the flexible cord 14. For example, as the user is pulling the trolley 4 along the angled shaft 2 in an upward direction, the wheels 20 underneath the shaft 2 will spin in an opposite direction than the wheels 20 on the trolley 4 above the shaft 2. The wheels 20 of the trolley 4 underneath the shaft 2 will rotate, in the direction of the flexible cord 14, acting like a pulley.

In one embodiment, a side view of the collapsible beam 9 is more clearly observed. The upper collapsible beam 13 connects to the shaft 2 by the bolt 15, the bolt 15 being any connecting device such as a bolt, nail, screw, or other known adhesive commonly known in the art suitable for such purposes. The lower collapsible beam 12 is connected to the rear beam 16 with the bolt 15. In the center of the collapsible beam 9, the bolt 15 acts as a pivot structure allowing for the upper collapsible beam 13 and the lower collapsible beam 12 to rotate, pivot, extend, and pivotally move about the bolt 15. Additional features, as described in earlier figures, are also depicted as illustrated examples.

Figure 3A:
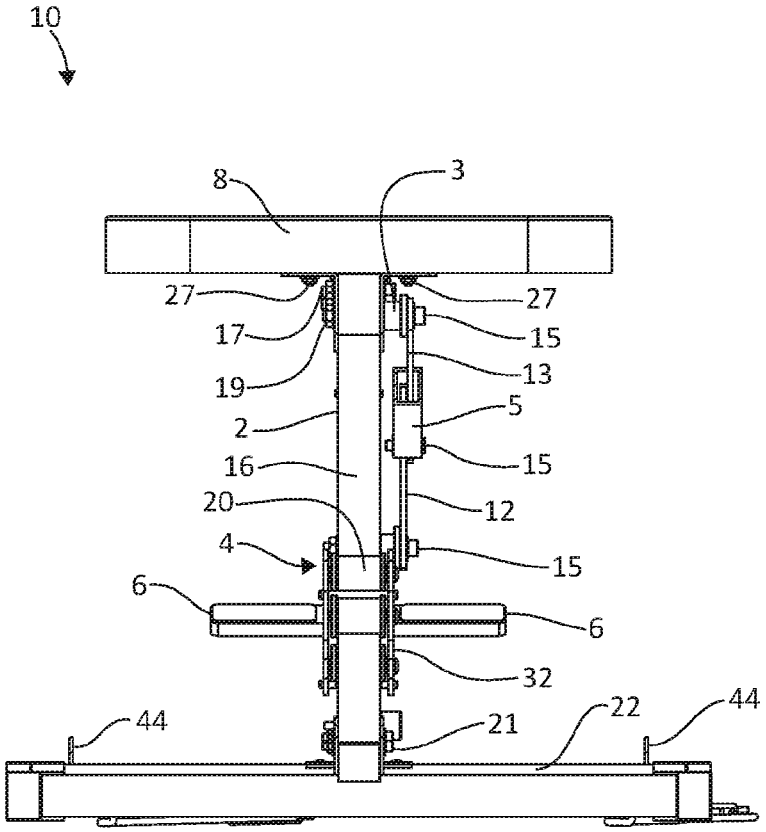
FIG. 3A illustrates an exemplary exercise device according to the present invention from a front view.
Figure 3B:
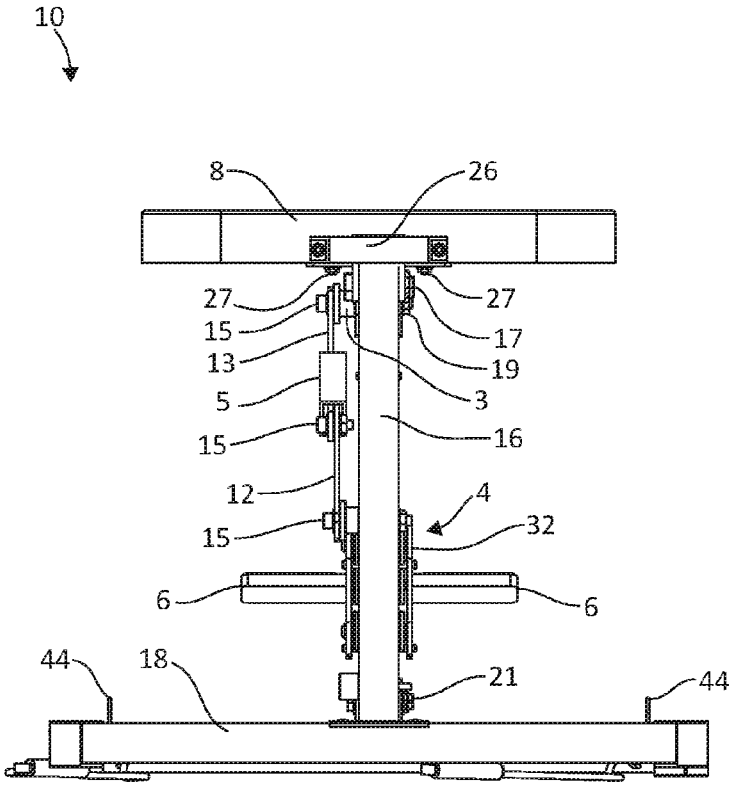
FIG. 3B illustrates an exemplary exercise device according to the present invention from a back view.

Turning to FIGS. 3A and 3B collectively, depicts more clearly the exercise device 10 in an exemplary embodiment from a front view, FIG. 3A, a side view FIG. 3B. As seen in both the front view and side view, in one embodiment, again the exercise device includes a shaft 2 with a trolley 4 for rolling along the shaft 2. The rear or right end of the shaft 2 is connected to the seat 8 and the collapsible beam 9 by a bolt 15. One example may include several bolts 27 connecting the seat 8 to the shaft 2, the bolts 27 being any connective means such as a bolt, nail, screw, pin, adhesive, or other device commonly used in the art for such connective purposes. The collapsible beam 9 may either be one piece or the collapsible beam 9 may centrally connect two separate attachment pieces, by means of the bolt 15, the bolt 15 being any connective means such as a bolt, nail, screw, pin, rod, or other device commonly used in the art for connection, so as to allow the collapsible beam 9 to pivot, extend, and collapse. The shaft 2 has a front or left end where the shaft 2 connects to the front foot 22 by a connection device 21.

In one example, both the front and side view illustrate that the collapsible beam 9, containing both the upper collapsible beam 13 and a lower collapsible beam 12 being connected to the shaft with the bolt 15, but a spacer 3 is utilized to provide a distance between the collapsible beam 9 and the shaft 2. The spacer 3 allows the collapsible beam 9 to extend, collapse, and for the slider 5 to move up and down the collapsible beam 9 without any contact with the shaft. The spacer 3 allows for the exercise device 10 to be set up or taken down with ease and simplicity. The spacer 3 may be of any type of material commonly used in the art for providing spacing and a buffer zone between the shaft and the upper collapsible beam 13 and the lower collapsible beam 12. The seat 8 also provides a seat handle 26 for gripping and holding on the to seat during exercise or for moving, lifting, holding, and transporting the exercise device 10.

In one exemplary embodiment, in both the front view and the side view, the wheels 20 of the trolley 4, which connect to the vertical plates 32, span the width of the shaft to a degree that vertical plates 32 are set out past the shaft 2. The spacing between the shaft and the vertical plates 32 allows for the trolley 4 to smoothly roll along the shaft. Additional features, as described in earlier figures, are also depicted as illustrated examples.

Figure 4:
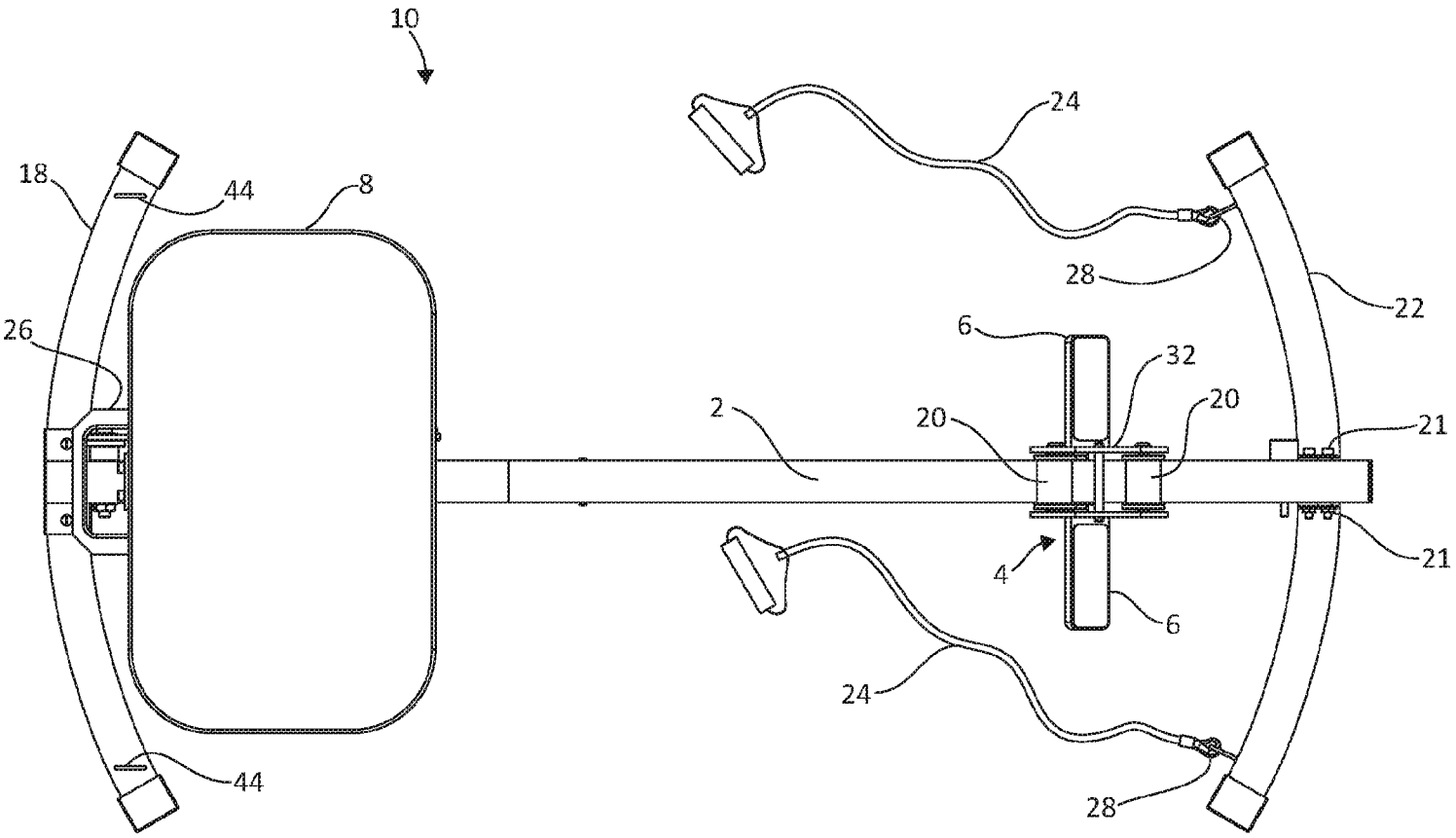
FIG. 4 illustrates an exemplary exercise device according to the present invention from a top view.

Turning to FIG. 4, an exemplary embodiment is depicted from the top view of an exercise device 10. The assembled exercise device 10 illustrates from a top view the top portion of the seat 8 and the seat handle 26 attached to the shaft 2. Further depicted, is the front side of the shaft 2 being attached via a connection device 21 to a front foot 22 for stability and stabilization. The front foot 22 may be straight, curved, or other geometric shape. The hooks 28 are attached to rings 44 which are secured to the either the front foot 22 and rear foot 18, both of which may include the rings 44 positioned at various locations on the front foot 22 or the rear foot 18. The hooks 28 attach to the rings 44 providing the option for flexible hand held cords 24 to be used by the user's hands for additional support, resistance, stability, exercise or other various needs for using the exercise device 10. The flexible hand held cords 24 may include a variety of handles commonly used in the art for providing a structure that holding or connecting to a rope. The flexible hand held cords 24 may be designed with differing strengths, lengths, materials, and resistance capabilities. The flexibility hand held cords 24 may easily attach and be removed from the rings 44 using the hooks 28. Additional features, as described in earlier figures, are also depicted as illustrated examples.

Figure 5:
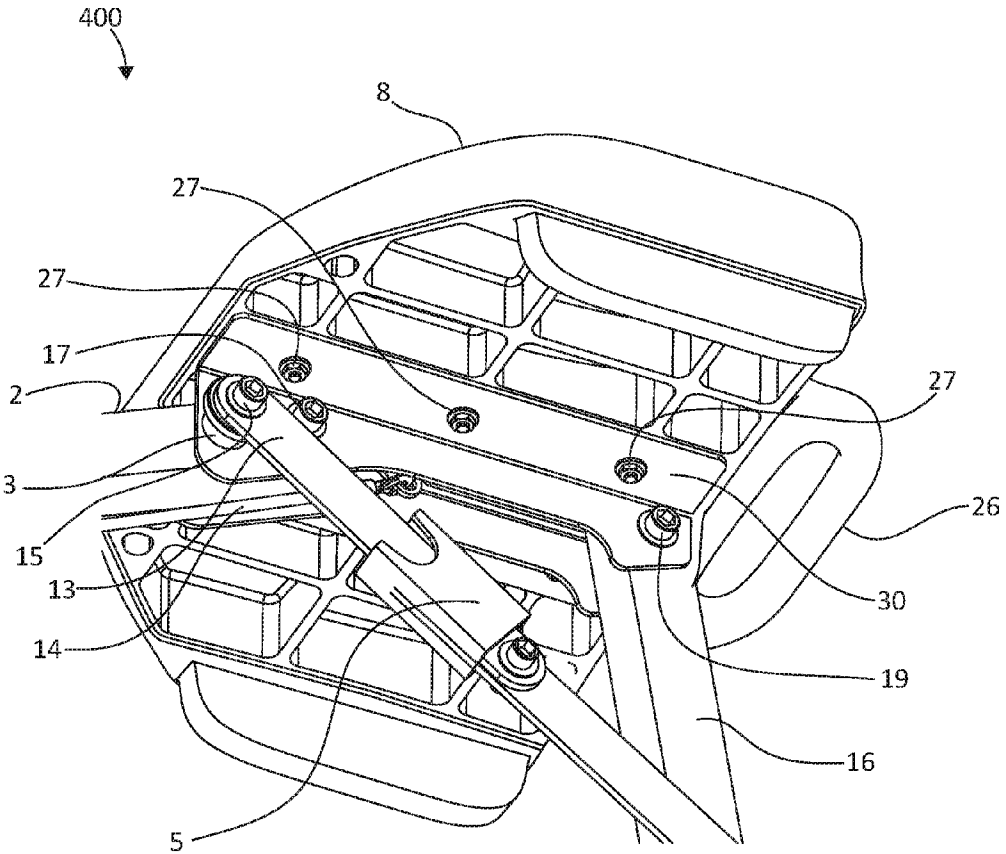
FIG. 5 illustrates an exemplary exercise device according to the present invention of a substantially planar surface seat connected to the shaft from a three dimensional bottom view.

Turning to FIG. 5 an exemplary embodiment depicts a three-dimensional view lower and back view of seat 8 connected to the shaft 2. As depicted in this example, the seat 8 has two substantially planar or horizontal surfaces; a top surface for seating upon the exercise device 10 and a bottom surface for connecting to the shaft 2. As illustrated from the back view looking at the bottom surface of the seat 8, the thickness of the seat 8 from the top surface to the bottom surface may vary depending upon the type of seat 8. The seat 8 may be made of any type of material for sitting, as commonly used in the art for sitting to accomplish such purpose. The seat 8 may have a handle attached to the rear of the seat 8, either assembled as a separate attachment or may be formed and created as one piece at the time of the creation of the seat 8. The bottom surface of the seat 8 is connected to the shaft 2 with two-attachment piece 30. Depicted as opposites in construction. The attachment piece 30 may be a separate connective piece used to connect the seat 8 to the shaft 2, or, in the alternative, the shaft 2 and the attachment piece 30 may be constructed as one singular piece.

As depicted in this example, the attachment piece 30 is separate from the shaft 2 and the seat 8. The rear end of the shaft 2 connects to the attachment piece 30 by bolt 15 and bolts 17. The attachment piece 30 is designed with a top surface that is substantially planer and substantially parallel with the seat 8. The attachment piece 30 has two sides that run from end to end, the height or depth of the left side begins to angle downward and longer than on the right side of the attachment piece 30. The angular depth of the longer left side allows the shaft 2 to fit into the attachment piece 30, the angle of the left side being nearly identical with the angle of the shaft 2. The right end of the attachment piece 30 includes additional depth for connecting the attachment piece 30 to the rear beam 16. The attachment piece 30 may connect to the shaft 2 on the left side of the attachment piece 30, the seat 8 on the top surface of the attachment piece 30, and the rear beam 16 on the right side of the attachment piece 30. On the top surface of the attachment piece 30, the seat 8 sits flush with the shaft 2 and is connected to the attachment piece 30 with the connecting bolts 27. The number of connecting bolts 27 may vary with the size, shape, and various dimensions of the seat 8. The attachment piece 30 connects to the rear beam 16 by a bolt 19. The attachment piece 30 and the seat 8 may be constructed and positioned allowing the option of adding an additional pulley under the seat 8. The additional pulley allows the option to connect the flexible cord 14 to the front foot 22 in a fixed position. For example, the flexible cord being connected to the front foot 22 may connect to the additional pulley under the seat. The additional pulley provides the flexible cord 14 to travel back down along the shaft 2 and attaching to the trolley 4. Reversing the attachments of the flexible cord 14 provides the capabilities for the user to start the trolley 4 near or at the top of the shaft. The user may then push downward on the peg 6 of the trolley 4 towards the ground with resistance to the person legs. Additional features, as described in earlier figures, are also depicted as illustrated examples.

Figure 6A:
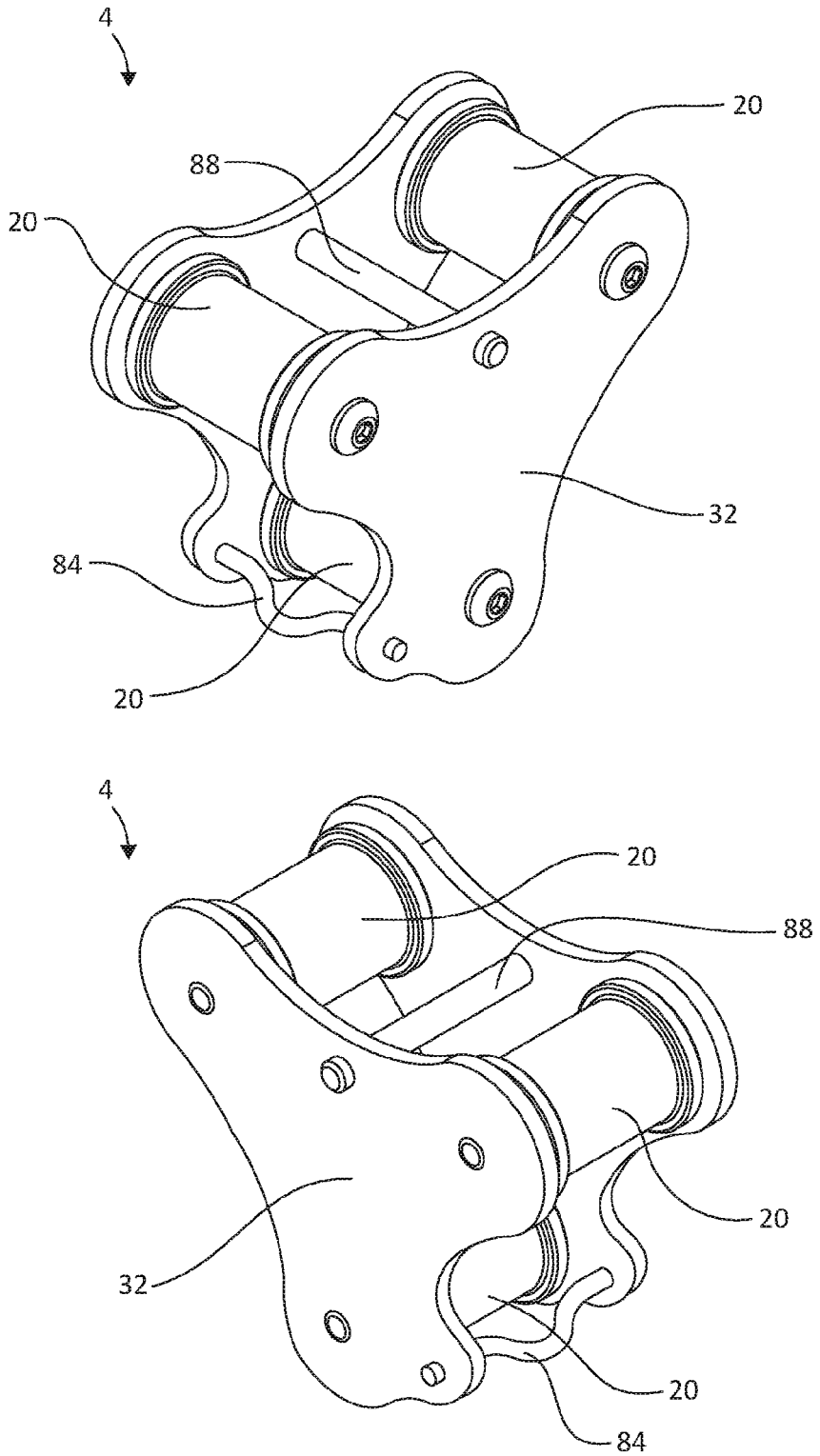
FIG. 6A illustrates an exemplary exercise device of a trolley according to the present invention from a three-dimensional side view.
Figure 6B:
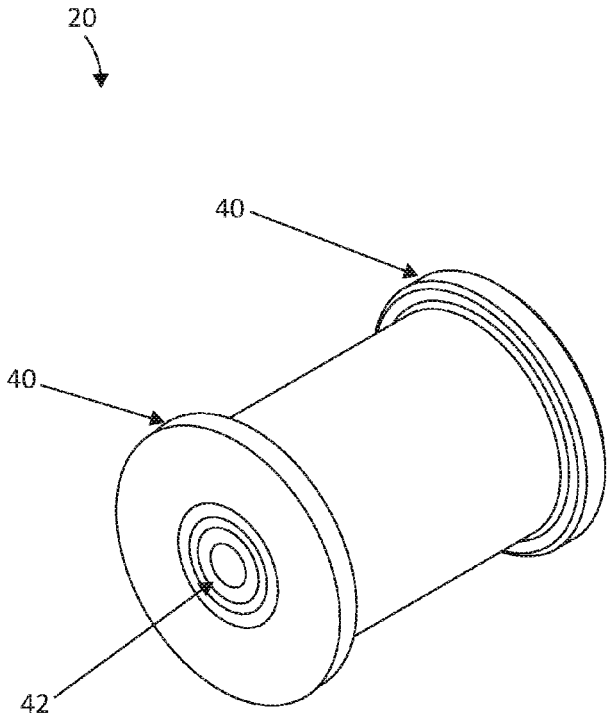
FIG. 6B illustrates an exemplary wheels for a trolley according to the present invention from a three dimensional view.

Turning to FIGS. 6A and 6B, an exemplary embodiment depicts a three-dimensional view a trolley 4 and the wheels of the trolley 4. The embodiment in FIG. 6A illustrates one example of the trolley 4 assembled together with the wheels 20 attached, and in FIG. 6B one example illustrates the wheels 20 of the trolley 4.

Turning to FIG. 6A, in the depicted embodiment the trolley 4 is formed by using two vertical plates 32 and three wheels 20. The vertical plates 32 may be designed using a variety of shapes, sizes, and materials, commonly known in the art to accomplish such purpose. One useful option may include the vertical plates 32 to be designed so the upper portion of the vertical plates 32 may connect or attach the two wheels 20 to each end of the upper portion of the vertical plates 32. In the center of the upper portion of the vertical plates 32 a structural pin 88 may be inserted for structural integrity, support, and stabilization of the trolley 4. The structural pin 88 may be a separate piece or may be a designed and manufactured as one singular piece; the two vertical plates 32 and the structural pin 88 being one singular piece with the wheels 20 to be attached separately.

Each of the vertical plates 32 may include openings for the wheels 20 and the structural pin 88 to be attached with any pin, bolt, peg, nail, screw, dowel, shaft, drill blank, or any other connective device commonly used in the art to accomplish such purposes. This method of attachment may be either temporary such as bolt and nut or permanent such as welding or a press fit. The vertical plates 32 may include a third wheel 20 to be attached and connected to the lower portion of the vertical plates 32. The wheels 20, being connected to the upper portion of the vertical plates 32, may span the width of the top portion of the shaft 2 and assist in rolling the trolley 4 along the shaft 2. The wheels 20, being connected to the lower portion of the vertical plates 32, may roll along the bottom of the shaft to assist the trolley 4 moving along the shaft 2. Alternatively, the wheels 20 connecting to the bottom portion of the vertical plates 32 may also assist the flexible cord 14 by serving as an additional pulley for the flexible cord 14. For example, depending upon the amount of weight placed upon the trolley 4, the wheels 20, connected to the lower portion of the vertical plates 32, may not touch or roll along the shaft 2. Rather, sufficient spacing exits between the bottom of the shaft 2 and the bottom wheels 20 of the trolley 4. The wheels 20 on the bottom portion of the vertical plates 32 may be free spinning acting as a pulley for the flexible cord 14; the bottom wheels 20 of the trolley 4 may be spinning in the same direction as the flexible cord 14 and opposite the direction of the top wheels 20 of the trolley 4.

The bottom portion of the vertical plates 32 may include a connective pin 84 for attaching the flexible cord 14 to the trolley 4. The connective pin 84 may be a separate piece or may be a designed and manufactured as one singular piece, meaning the two vertical plates 32 and the connective pin 84 being one singular piece with the wheels 20 to be attached separately. The connective pin 84 may be any pin, bolt, peg, nail, screw, or any other connective device commonly used in the art to accomplish such purposes. If the connective pin 84 is a separate piece, the connective pin 84 be removed, interchanged, and replaced. Various tolerance levels may be determined by the type, shape, and durability of the material of the connective pin 84 for supporting and providing resistance to the flexible cord 14. One or multiple flexible cords 14 may be attached to the connective pin 84.

Turning to FIG. 6B, in the depicted embodiment, the wheels 20 of the trolley 4 are more clearly displayed. The trolley 4 may use a total of three wheels 20. The design of the wheels 20 may use three double-flanged wheels for the trolley 4 spanning the width of the shaft 2. The wheels 20 may be a spool design with a variety of materials for minimizing rolling resistance while providing support for the trolley 4. The wheels 20 may have wheel edges 40 that are higher on the sides than in the center of the wheels 20. The material for the wheels may include, but not limited to, plastic, fiber, fiberglass, carbon fiber, composite, polymers, sponge, metal, or any other type of material or combination of materials commonly know in the art for a wheels to accomplish such purposes. The wheels 20 may include a centerpiece 42, which may include more than one bearing, bushings, or other devices for assistance in rolling as commonly used in the art. Such designs may eliminate tolerance stacking and simplifies fabrication and assembly costs. The wheels 20 may include a center opening for a pin, screw, bolt, or other device commonly used in the art. The wheels 20 may be machined inside to various tolerances and bearing depths. One useful example may include the bearings positioned inside of the wheels 20 adapted to avoid riding on the threads of a bolt or pin to prevent fretting.

Figure 7:
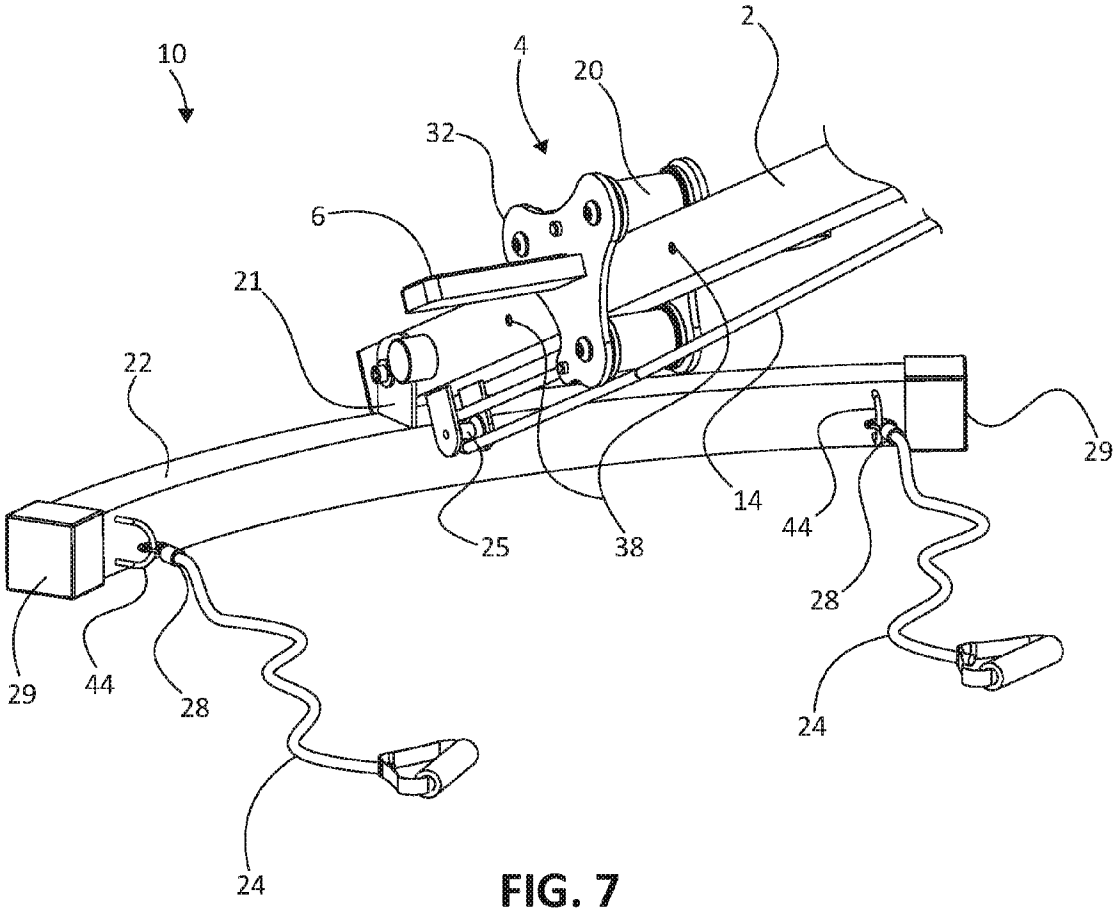
FIG. 7 Illustrates an exemplary trolley and shaft from a three-dimensional view of the bottom according to the present invention.

Turning to FIG. 7, in the depicted embodiment the trolley 4, shaft 2, and the front foot 22 are more clearly displayed. In one embodiment, the shaft 2 has a front end. The front end is attached via a connection device 21 to a front foot 22 for stability and stabilization. The connection device 21 may include angled brackets, mounting clamps, or other type of connection devices known in the art for attaching structures together, and may be a separate component or as a permanent structure to either the shaft 2 or the front foot 22.

In one embodiment, the peg 6 allows the user to place on, beneath, inside, above, or securely fix the users feet to the peg 6 to pull or push the trolley 4 along the shaft. The peg 6 may include attachment devices, such as Velcro®, straps, pedals, or other devices to fix to users feet onto the peg 6. One useful option may include the shaft 2 angled upwards towards the user, and with the users feet on the peg 6 of the trolley 4, pull the trolley 4 along the shaft 2 upwards along the shaft 2 until the trolley 4 reaches a desired ending position or the top of the shaft 2. Once the trolley 4 is at the peak or furthest closest position to the user, the trolley 4 may stop and roll down the angled shaft 2 to the original starting position for another repetition. For example, the trolley 4 may roll down the shaft by gravity, the flexible cord 14, the users feet, or a combination of gravity, the flexible cord 14, and the users feet. The flexible cord 14 is more clearly depicted in wrapping around the pulley 25. If needed, the flexible cord 14 may also use the lower wheels 20 of the trolley to assist as an extra pulley.

Hooks 28 are attached to rings 44, which are secured to the front foot 22 and rear foot 18. The hooks 28 attach to the rings 44 providing the option for flexible hand held cords 24 to be used by the user's hands for additional support, resistance, stability, exercise or other various needs for using the exercise device 10. The end caps 29 are more clearly depicted as they connect semi permanently or permanently to the front foot 22. Additional features, as described in earlier figures, are also depicted as illustrated examples.

Figure 8:
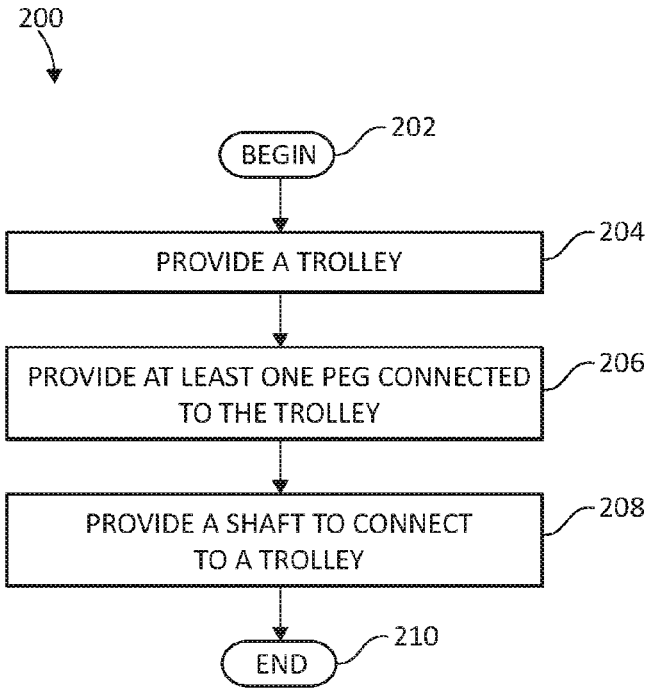
FIG. 8 illustrates a flow chart diagram of an exemplary method for manufacturing an exercise device with a trolley.

FIG. 8 depicts one exemplary method 200 of manufacturing an exercise device. The method of manufacturing begins (step 202) with providing a trolley 4 (step 204). As a next step, at least one peg is provided connected to the trolley 4 (step 206). As a final step, a shaft is provided connected to the trolley 4 (step 208). The method 200 then ends (step 210).

Figure 9:
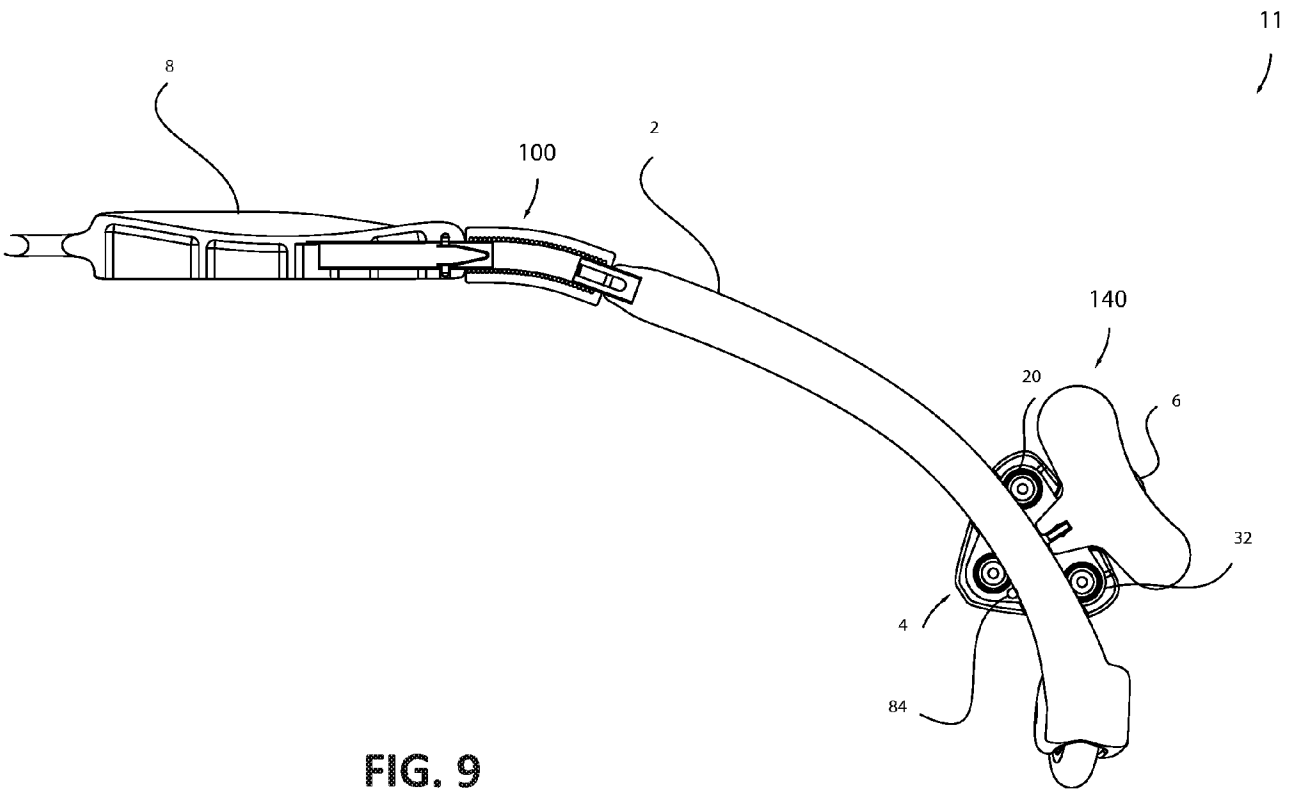
FIG. 9 illustrates an additional exemplary exercise device according to the present invention from a side view.

FIG. 9 illustrates an additional exemplary exercise device 11 according to the present invention from a side view. Referring to FIG. 9, showing a perspective side view, is a depiction of one example of an exercise device 11. The exercise device 11 may be composed of steel, iron, a high-strength lightweight alloy material, any metallic material, polyvinyl chloride (PVC) material, polyurethane material, a composite material such as a carbon fiber layup, polymer, a joint metallic and polyurethane material, or any other material known in the art suitable for such an application. One useful option for the composition of the exercise machine 11 may, for example, include carbon steel.

The shaft 2 is the central piece and backbone for strength, stability, and durability for the exercise device 11. The shaft 2 is connected to a flexible mechanism 100 (e.g., a spring weldment). The flexible mechanism 100 is then connected to a seat 8, which may be substantial planer surface, as shown. The shaft 2 may be of a variety of lengths, shapes and sizes, depending upon the users needs. One useful option for the shaft 2 may include either a straight or curved shaft with very strong and rigid 1.50"×1.50" inch square or circular steel tubing resistant to the wear and tear of the motion of the trolley 4. This shaft 2 may also be injection molded, cast, 3D laser printed or other manufacturing techniques allowing compound curvatures to be created to provide structural strength and also be aesthetically pleasing. The flexible mechanism 100 comprises a portion of the shaft 2 placed in one of a variety of positions of the shaft between the first end and the second end for allowing at least one portion of the shaft to move and rotate in one of a plurality of motions and angles, and the shaft 2 accommodates the trolley.

In one embodiment, the seat 8 may be a large, stable, and comfortable seat 8, semi-permanently or permanently connected to the rear end of the shaft 2 via the flexible mechanism 100. The seat 8 may be of any type of rubber, plastic, foam, fibrous substance, cloth, synthetic material, or any other type of material known in the art, which are suitable for such an application.

In one embodiment, the trolley 4 may include a foot locking mechanism 6 (e.g., a peg, pedal, strap, stirrup, and the like), and wheels for allowing trolley 4 to roll along the shaft 2 in a forward, backward, upward, downward, or any other directional motion. The trolley 4 consists of the foot locking mechanism 6 connected to the vertical plates 32. Multiple foot locking mechanisms 6 may connect to the trolley 4. The trolley 4 may include adding additional free or external weights 113 to the foot locking mechanisms 6. Each of the vertical plates 32 are placed on opposite sides of the shaft 2. The wheels 20 of the trolley 4 are connected to each of the vertical plates 32. One useful option may include two wheels 20 connected to upper portion of the vertical plates 32. The trolley 4 third wheels 20 may connect to each of the lower portion of the vertical plates 32 and be underneath the shaft 2. The two top wheels 20 of the trolley 4 may span the width of the shaft 2 and roll along the top of the shaft 2. The third wheels 20 of the trolley 4, located on the lower portion of the vertical plates 32, may also span the width of the shaft 2 but may or may not come in contact and roll along the shaft 2. The shaft 2 includes various openings 38 allowing for the use of a ball lock pin, or other device commonly known in the art, allowing the trolley 4 to be positioned along the shaft 2 in various locations to accommodate various users' leg lengths. The various openings 38 may be placed throughout the shaft 2 and may include multiple various openings 38.

In one embodiment, the locking foot mechanisms 6 allow the user to place on, beneath, inside, above, or securely fix the users feet to the locking foot mechanism 6 to pull the trolley 4 along the shaft. The locking foot mechanisms 6 may include attachment devices, such as Velcro®, straps, pedals, or other devices to fix to users feet onto the locking foot mechanism 6. One useful option may include the shaft 2 angled upwards towards the user, and with the users feet on the locking mechanism 6 of the trolley 4, pull the trolley 4 along the shaft 2 upwards along the shaft 2 until the shaft 2 reaches a desired ending position or the top of the shaft 2 just prior to reaching the flexible mechanism 100. Once the trolley 4 is at the peak or furthest closest position to the flexible mechanism 100 and/or user, the trolley 4 may stop and roll down the shaft 2, which may be angle and/or curved, to the original starting position for another repetition. For example, the trolley 4 may roll down the shaft by gravity, the users feet, the weights attachment 140, or a combination of gravity, the weights 113, and the users feet.

Figure 10:
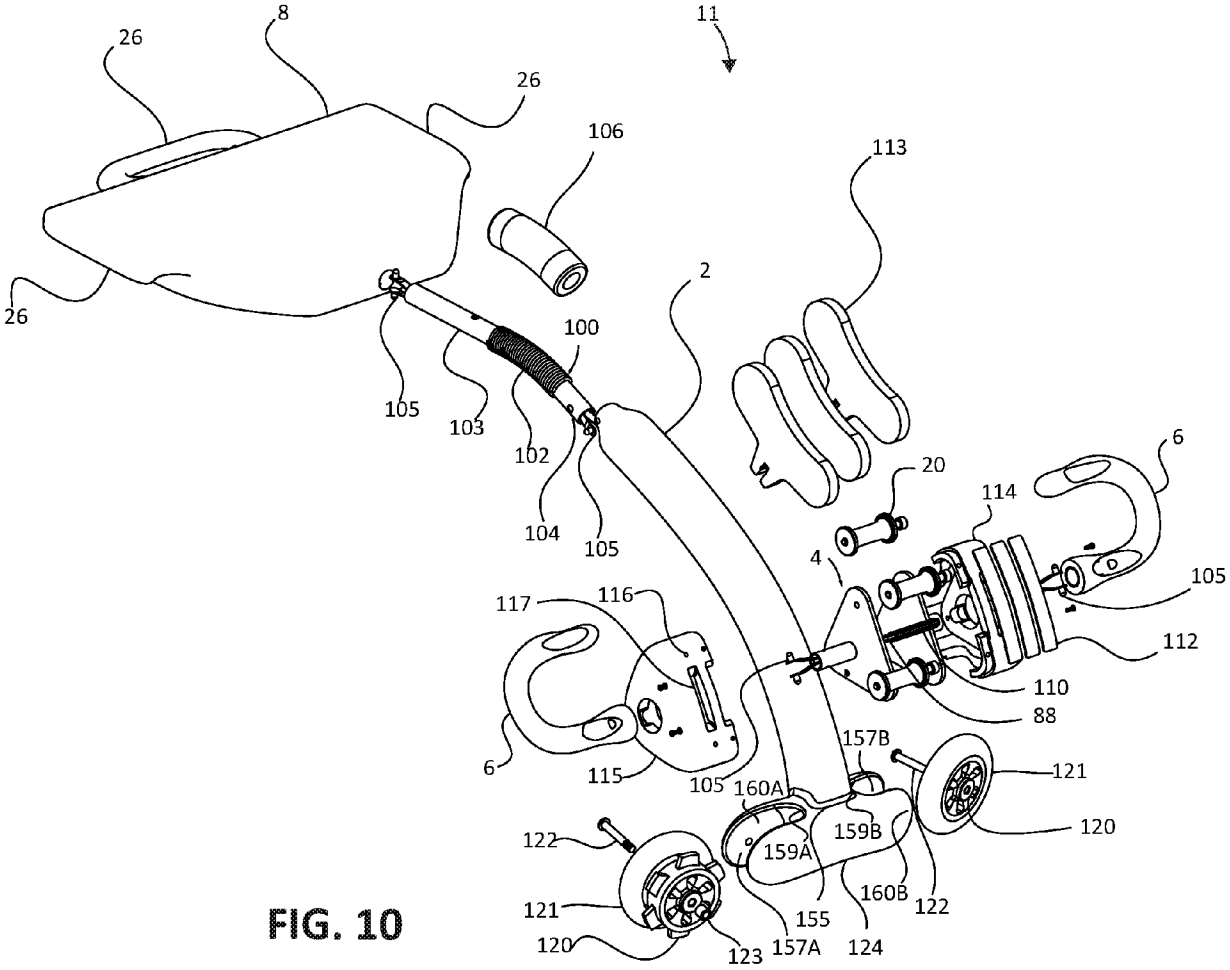
FIG. 10 illustrates an additional exemplary exercise device according to the present invention from a three dimensional side view.

FIG. 10 illustrates an additional exemplary exercise device according to the present invention from a perspective three-dimensional side view. The exercise device 11 may be composed of steel, iron, a high-strength lightweight alloy material, any metallic material, polyvinyl chloride (PVC) material, polyurethane material, a composite material such as a carbon fiber layup, polymer, a joint metallic and polyurethane material, or any other material known in the art suitable for such an application. One useful option for the composition of the exercise machine 11 may, for example, include carbon steel.

The shaft 2 is the central piece and backbone for strength, stability, and durability for the exercise device 11. The shaft 2 is connected to a flexible mechanism 100 (e.g., a spring weldment). The flexible mechanism 100 is then connected to a seat 8, which may be substantial planer surface, as shown. The shaft 2 may be of a variety of lengths, shapes and sizes, depending upon the users needs. One useful option for the shaft 2 may include either a straight or curved shaft with very strong and rigid 1.50"×1.50" inch square or circular steel tubing resistant to the wear and tear of the motion of the trolley 4. The flexible mechanism 100 comprises a portion of the shaft placed in one of a variety positions of the shaft between the first end and the second end for allowing at least one portion of the shaft to move and rotate in one of a plurality of motions and angles, the shaft adapted for accommodating the trolley.

Figure 11:
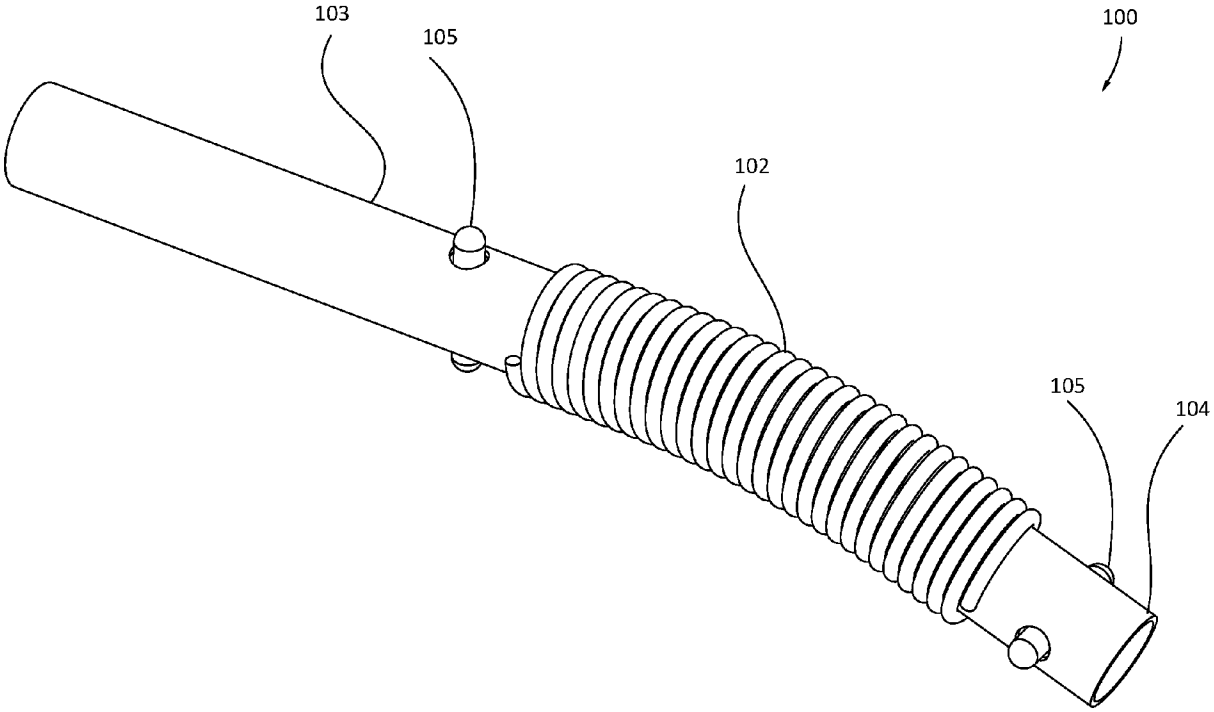
FIG. 11 illustrates an exemplary flexible mechanism according to the present invention from a side view.

The flexible mechanism 100, which is illustrated in greater detail in FIG. 11, includes an upper portion 103 (e.g., an upper tubing or other pliable and flexible material) and a lower portion 104 (e.g., a lower tubing or other pliable and flexible material). A spring 102 may be used to connect the upper portion 103 with the lower portion 104 to form the flexible mechanism 100. A connection device 105 (e.g., a quick spring clip, pin, lock, clipping device, spring, bolt, screw, and plug) is used to connect the seat 8 to the upper portion 103 of the flexible mechanism 100 and the lower portion 104 of the flexible mechanism 100 to the shaft 2. In one embodiment, the flexible mechanism 100 may replace the shaft 2 completely, and operate as a flexible shaft mechanism 100.

In one embodiment, the seat 8 may be a large, stable, and comfortable seat 8, semi-permanently or permanently connected to the upper portion 103 of the flexible mechanism 100, using the connection device 105, that is in turn connected to the shaft 2 via the lower portion 104 of the flexible mechanism 100 also using the connection device 105. The seat 8 includes a variety of seat handles 26 that may be located and positioned in one of a variety of locations on the seat 8. A protective cover 106 is used to cover the spring 102 of the flexible mechanism for protecting the user from exposure to the spring 102. The protective cover 106 may be composed of polychloroprene (Neoprene®) foam, rubber, elastomeric material, latex, vulcanized rubber, or any other material known in the art suitable for such an application.

In one embodiment, the trolley 4 may include a foot locking mechanism 6 (e.g., a peg, pedal, strap, stirrup, and the like), and wheels for allowing trolley 4 to roll along the shaft 2 in a forward, backward, upward, downward, or any other directional motion. The trolley 4 consists of the foot locking mechanism 6 connected to the vertical plates 32 using the connection device 105. Multiple foot locking mechanisms 6 may connect to the trolley 4 using the connection device 105. The trolley 4 may include adding additional free or external weights 113 using a weight attachment 140, which is illustrated in greater detail in FIG. 12, to the foot locking mechanisms 6. Each of the vertical plates 32 (see FIG. 9) is placed on opposite sides of the shaft 2. The wheels 20 of the trolley 4 are connected to each of the vertical plates 32 (see FIG. 9). One useful option may include two wheels 20 connected to upper portion of the vertical plates 32 (see FIG. 9). The trolley 4 third wheels 20 may connect to each of the lower portion of the vertical plates 32 (see FIG. 9) and be underneath the shaft 2. The two top wheels 20 of the trolley 4 may span the width of the shaft 2 and roll along the top of the shaft 2. The third wheels 20 of the trolley 4, located on the lower portion of the vertical plates 32 (see FIG. 9), may also span the width of the shaft 2 but may or may not come in contact and roll along the shaft 2. The shaft 2 includes various openings 38 allowing for the use of a ball lock pin, or other device commonly known in the art, allowing the trolley 4 to be positioned along the shaft 2 in various locations to accommodate various users' leg lengths. In the center of the upper portion of the vertical plates 32 (see FIG. 9) a structural pin 88 may be inserted for structural integrity, support, and stabilization of the trolley 4. Slot covers 112 are used to cover a male trolley shield 114 and a female trolley shield 115. A trolley weight clip 110 is used to receive the weights 113.

In one embodiment, the locking foot mechanisms 6 allow the user to place on, beneath, inside, above, or securely fix the users feet to the locking foot mechanism 6 to pull the trolley 4 along the shaft. The locking foot mechanisms 6 may include attachment devices, such as Velcro®, straps, pedals, or other devices to fix to users feet onto the locking foot mechanism 6. One useful option may include the shaft 2 angled upwards towards the user, and with the users feet on the locking mechanism 6 of the trolley 4, pull the trolley 4 along the shaft 2 upwards along the shaft 2 until the shaft 2 reaches a desired ending position or the top of the shaft 2 just prior to reaching the flexible mechanism 100. Once the trolley 4 is at the peak or furthest closest position to the flexible mechanism 100 and/or user, the trolley 4 may stop and roll down the shaft 2, which may be angle and/or curved, to the original starting position for another repetition. For example, the trolley 4 may roll down the shaft by gravity, the users feet, the weights 113 or a combination of gravity, the weights 113, and the users feet. In one embodiment, the locking foot mechanisms 6 is connected to the trolley 4 via an opening in female trolley shield 115 and the male trolley shield 114 using the connection device 105. The female trolley shield 115 includes one or more slot cover holes 116 and a trolley shield slot.

In one embodiment, a housing apparatus 124 (e.g., a multi-wheel housing) is connected substantially perpendicular to the first end of the shaft 2. The housing apparatus 124 having at least one end for receiving and housing the at least one alternative wheel 121 using a wheel hub 120 having an insert 123 for receiving an axle bolt 122 for connecting the at least one alternative wheel 121 to the housing apparatus 124 for allowing the shaft to move and rotate in one of a variety of motions and angles.

In one embodiment, the housing apparatus 124 may include angled brackets, mounting clamps, or other type of connection devices known in the art for attaching structures together, and may be a separate component or as a permanent structure to either the shaft 2.

In one embodiment, the housing apparatus 124 may have a first plate 160A in parallel with a second plate 160B with a shaft receptor region 155 being formed in the middle by the first plate 160A and the second plate 160B having a substantially curved first piece 159A and a substantially curved second piece 159B being used to connect each of the plates 160A and 106B. The substantially curved first piece 159A is spaced apart (the distance varies according to shaft size and user preference) from the substantially curved second piece 159B with the apex of each of the curved piece 159A and 159B being placed in a back-to-back with a gap existing between the two pieces 159A and 159B. In one embodiment, the first plate 160A and the second plate 160B substantially form an "H" shape with the center 155, created from the substantially curved first 159A and second piece 159B, being open for receiving the shaft.

In some embodiments, the housing apparatus 124 may include a first portion 157A and a second portion 157B. The first plate 160A and the second plate 160B may for the first portion and the second portion 157 and 157B. The first portion 157A may be joined to the second portion 157B at a shaft reception region 155. The first portion 157A may include a free end that is distal from the shaft reception region 155. The second portion 157B may include a free end that is distal from the shaft reception region 155. The free end of the first portion 157A may be located at a different location than the free end of the second portion 157B. The first portion 157A may extend away from the shaft reception region 155 to the free end of the first portion 157A. The second portion may extend away from the shaft reception region 155 to the free end of the second portion 157B. In one embodiment, the housing apparatus 124 may only include either the first portion 157A or the second portion 157B for housing only one wheel.

In one embodiment, the housing apparatus 124 may be composed of steel, iron, a high-strength lightweight alloy material, any metallic material, polyvinyl chloride (PVC) material, polyurethane material, a composite material such as a carbon fiber layup, polymer, a joint metallic and polyurethane material, or any other material known in the art suitable for such an application. One useful option for the composition of the housing apparatus 124 may, for example, include carbon steel.

In some embodiments, the first and second portions 157 may further extend away from the shaft reception region 155 in such a manner that the first and second portions 157 extends away from the shaft reception region 155 in a linear, perpendicular, angled, and or other geometric position the depending upon manufacturer and/or owner specification. The angle may be measured from a surface of the shaft reception region 155 that is proximate to either the free end of the first portion 157A and also to the to a surface of the shaft reception region 155 that is proximate the free end of the second portion 157B. In some embodiments, the angle may be equal to or greater than approximately 45°, 90°, and/or 180°. In one embodiment, the first portion 157A may further extend away from the shaft reception region 155 in such a manner that the first portion 157A defines an angle of approximately 45°, 90°, and/or 180° where the angle is measured a surface of the shaft reception region 155 that is proximate to either the free end of the first portion 157A. In one embodiment, the second portion 157B may further extend away from the shaft reception region 155 in such a manner that the second portion 157B defines an angle of approximately 45°, 90°, and/or 180° where the angle is measured a surface of the shaft reception region 155 that is proximate to either the free end of the second portion 157B.

In some embodiments of the housing apparatus 124, the surface of the first portion 157A is an inner facing surface, and the surface of the second portion 157B is an inner facing surface. In some embodiments of the housing apparatus 124, the surface of the first portion 157A and/or the surface of the first plate 160A may be substantially planar, and the surface of the second portion 157B and/or the surface of the second plate 160B may be substantially planar. In yet further embodiments of the housing apparatus 124, the first portion 157A, the first plate 160A, the second portion 157B, and the second plate 160B may be integrally formed to define a single, continuous body. In still yet further embodiments, the first portion 157A of the housing apparatus 124 may take the form of a lower portion or a lower leg of the housing apparatus 124 if only the first portion 157 is used. In this configuration, the shaft reception region 155 would for the upper leg or upper portion of the housing apparatus 124 and the first portion 157A of the housing apparatus 124 forming the lower portion or the lower leg of the housing apparatus 124. As such, the housing apparatus 124 would have a "U" shape with the apex of the "U" shape forms and provide all or part of the shaft reception region 155 (e.g., an opening is formed at the apex of the "U" shape such as a square bracket may being added and/or or designed from the apex to form and/or provide this region) that connects to the shaft.

In some embodiments, the first 157A and second 157B portions each form a central portion defining at least one hole sized to receive a portion of an insert 123, a wheel hub 120, an axle bolt 122, and the wheel 121 therein. In still further embodiments, the first 157A and second 157B that form the central portion may define a recess or cavity configured to receive a portion of the insert 123, the wheel hub 120, the axle bolt 122, and the wheel 121 therein.

It should be noted that in the event of more than one wheel 121 (e.g., one ore more roller blade wheels), the 2 bolt axles 122 do not run parallel to each other because it makes the wheels 121 bind. The bolt axles 122 need to be at a slight angle (which may vary according to design and user preference) to each other. That angle is determined by the general length of the shaft in relation to the average pivot point of the flexible mechanism 100 (e.g., a spring). In other words, when both wheels 121 are touching the ground, if the user swings the shaft 2 to the left and/or to the right, the exercise device, more specifically the shaft 2, essentially makes an arc or circle. Nominally, each wheel is aligned to the circle tangency that would be created by swinging said arc.

Figure 12:
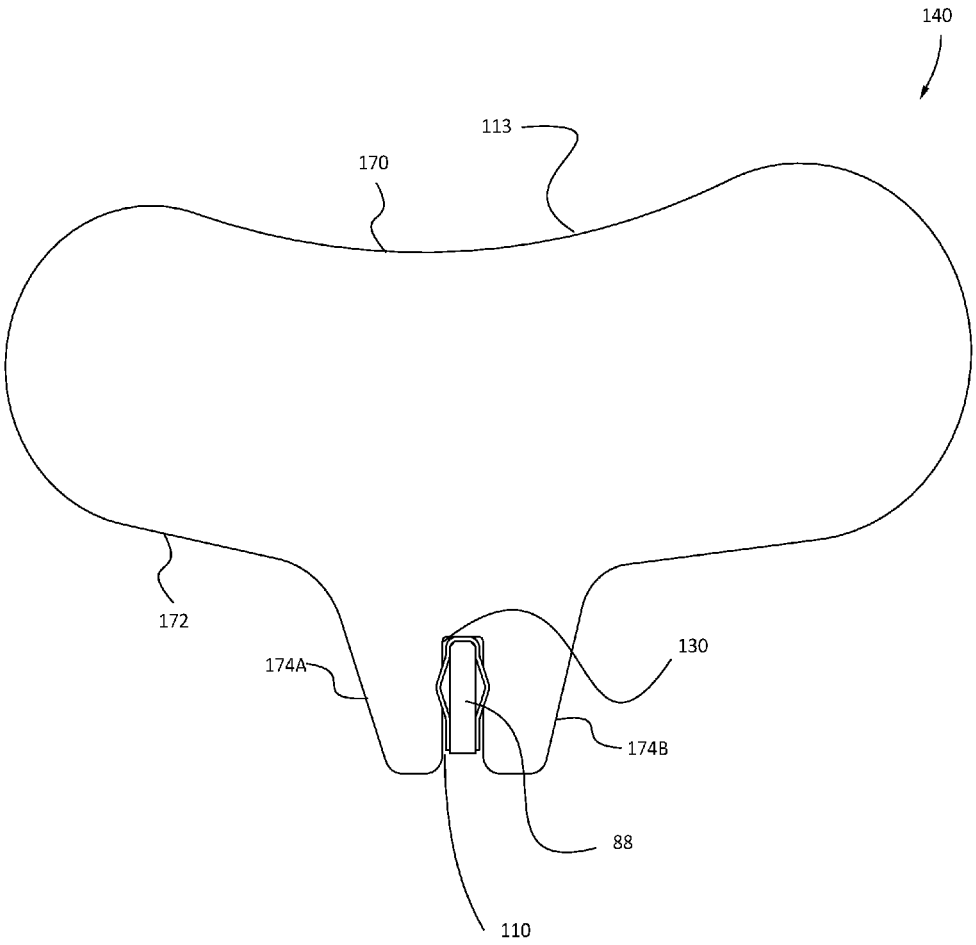
FIG. 12 illustrates an additional exemplary weight for securing to the trolley according to the present invention from a side view.

FIG. 12 illustrates an additional exemplary weight for securing to the trolley according to the present invention from a side view. As more clearly illustrated in FIG. 12, one or more weights 113, having one of a variety of shapes and sizes secures to the trolley 4 by a trolley weight clip 110 and structural pin 88. An attachment surface 130 (e.g., a reception bracket located on the weight 113) is configured for receiving the trolley weight clip 110 and structural pin 88. In one embodiment, each weight 113 may be substantially planar having a substantially rectangular, oval, circular, diamond, and/or other geometrically desired cross-sectional shape based on manufacturer and/or user preferences. The weights 113 have a top portion 170 which may have a concave shape and a lower portion 172. At some defined location on the lower portion 172 two extending portions 174A and 174B project downwardly from the lower portion for creating an opening for receiving the trolley weight clip 110 and structural pin 88. The two extending portions form a central portion, creating the attachment surface 130, that define a recess or cavity configured to receive a the trolley weight clip 110 and structural pin 88.

In one embodiment, the weights 113 are composed of a steel, iron, a high-strength lightweight alloy material, any metallic material, polyurethane material, a composite material such as a carbon fiber layup, polymer rubber, plastic, foam, fibrous substance, and/or other synthetic material for providing additional weight and/or resistance.

Figure 13:
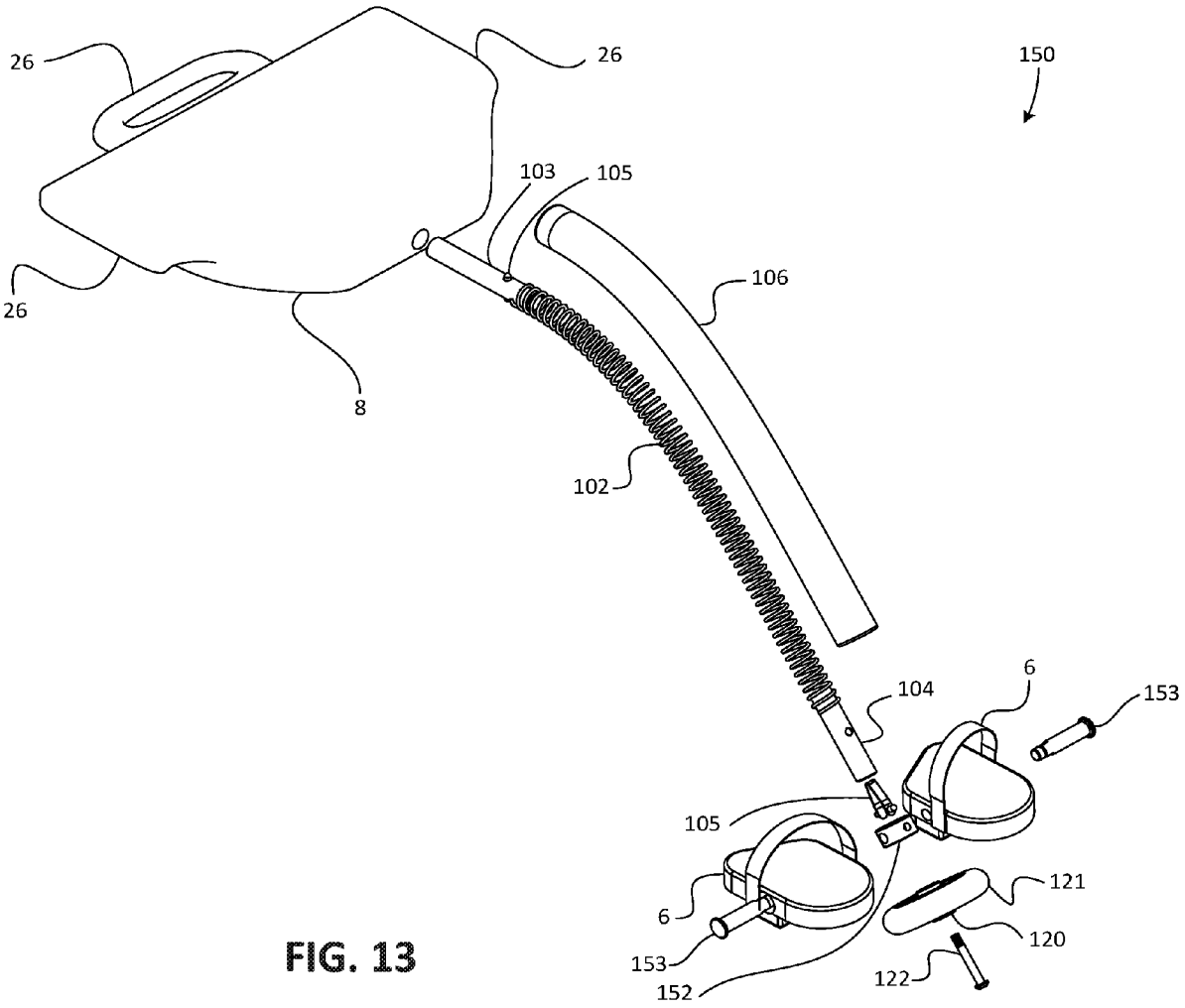
FIG. 13 illustrates an additional exemplary exercise device according to the present invention from a perspective view side view.

FIG. 13 illustrates an additional exemplary exercise device according to the present invention from a perspective view side view. In one embodiment, the exercise device 150 (e.g., a full spring exercise device) may be composed of steel, iron, a high-strength lightweight alloy material, any metallic material, polyvinyl chloride (PVC) material, polyurethane material, a composite material such as a carbon fiber layup, polymer, a joint metallic and polyurethane material, or any other material known in the art suitable for such an application. One useful option for the composition of the exercise machine 150 may, for example, include carbon steel.

In one embodiment, the flexible mechanism 100 (See FIG. 11) is the central piece and backbone for strength, stability, and durability for the exercise device 150. In one embodiment, the flexible mechanism 100 operates as a flexible shaft mechanism 100. The a flexible shaft mechanism 100 (See FIG. 11) is then connected to a seat 8, which may be substantial planer surface, as shown. The flexible mechanism 100 (See FIG. 11) may be of a variety of lengths, shapes and sizes, depending upon the users needs. One useful option for a flexible mechanism 100 (See FIG. 11) may include either a straight or curved spring 102 with very strong and rigid 1.50"×1.50" inch steel tubing (or other material used for creating a spring mechanism) resistant to the wear and tear of the motion. The spring 102 allows the flexible mechanism 100 (See FIG. 11) to move and rotate in one of a plurality of motions and angles. Because the flexible mechanism 100 is easily connected and disconnected from the exercise machine 11 (FIG. 9) and 150 (FIG. 13), the user can easily change to a stiffer or weaker flexible mechanism 100 to suit their workout needs.

The flexible mechanism 100, which is illustrated in greater detail in FIG. 11, includes an upper portion 103 (e.g., an upper tubing or other pliable and flexible material) and a lower portion 104 (e.g., a lower tubing or other pliable and flexible material). The spring 102 may be used to connect the upper portion 103 with the lower portion 104 to form the flexible mechanism 100 (See FIG. 11). A connection device 105 (e.g., a quick spring clip, pin, lock, clipping device, spring, bolt, screw, and plug) is used to connect the seat 8 to the upper portion 103 of the flexible mechanism 100 and the lower portion 104 of the flexible mechanism 100 to a pedal collar 152. The pedal collar 152 is a collar device defines a variety of openings for receiving and securing via a pedal collar bolt 153 a foot locking mechanism 6 (e.g., a pedal like device). Also, the pedal collar, using one of the varieties of openings, receives an axle bolt 122, which is traversed through the wheel hub 120 of the wheel 121, for securing the wheel 121 to the pedal collar 152 or both the pedal collar 152 and the lower portion 104 of the flexible mechanism 100 (See FIG. 11).

In one embodiment, the seat 8 may be a large, stable, and comfortable seat 8, semi-permanently or permanently connected to the upper portion 103 of the flexible mechanism 100, using the connection device 105. The seat 8 includes a variety of seat handles 126 that may be located and positioned in one of a variety of locations on the seat 8. A protective cover 106 is used to cover the spring 102 of the flexible mechanism for protecting the user from exposure to the spring 102.

Multiple foot locking mechanisms 6 may connect to the flexible mechanism 100 (See FIG. 11) using the connection device 105. The pedal bolts 153 may be of a variety of lengths and sizes and may include adding additional free or external weights 113 (see FIG. 12) for attaching to the foot locking mechanisms 6. In one embodiment, the locking foot mechanisms 6 allow the user to place on, beneath, inside, above, or securely fix the users feet to the locking foot mechanism 6 to pull, rotate and move the flexible mechanism 100 (See FIG. 11) by a user. The locking foot mechanisms 6 may include attachment devices, such as Velcro®, straps, pedals, or other devices to fix to users feet onto the locking foot mechanism 6. One useful option may include the spring 102 angled downward away from the user, and with the users feet on the locking mechanism 6, pull the flexible mechanism 100 (See FIG. 11) upwards, in a circular motion, side-to-side, and/or in a variety of movements for exercising the users body. In one embodiment, the seat 8 is placed on a secured platform (e.g., a couch, table, chair, bed, platform, and the like) and the users sits on the seat with the body weight of the user providing enough resistance for the seat to remain in a stable and secured position. Also, various adhesive and cushion devices (e.g., pads, tape adhesive, cushions, rubber devices, and the like) may also be secured to the lower portion of the seat for providing additional safety and protection to both the user and the secured platform. Once seated, the user inserts the user's feet into the foot locking mechanisms 6. Weights 113 may be added to the pedal collar 152, which may also contain the weight attachment (see FIG. 12), for providing additional resistance. The user then grasps the handles 26 and begins to move in one of a variety of directions the flexible mechanism 100 (See FIG. 11) across a floor. The wheel (or wheels) 121 may then roll along the floor while the flexible mechanism 100 (See FIG. 11) bends, flexes, and rotates. In one embodiment, the user may pulls the flexible mechanism 100 (See FIG. 11) upwards using the foot locking mechanism 6 thereby raising, lowering, rotating, angling, or moving upwards at a variety of speeds and motions for exercising.

A method of manufacturing and/or or systems may also be provide for each of the figures described herein. As such, for each component, a method of manufacturing provides each component and device described in each figure. While one or more embodiments of the present invention have been illustrated in detail, the skilled artisan will appreciate that modifications and adaptations to those embodiments may be made without departing from the scope of the present invention as set forth in the following claims.

What is claimed is:

1. An exercise device, comprising:

a trolley adapted to be pulled towards a user while the user is in a seated position, the trolley comprising:

at least two vertical plates with a first and a second side, at least three wheels with a first and a second end, the first and the second end of the at least three wheels being connected to the at least two vertical plates, and at least one foot locking device connected to the trolley, the at least one foot locking device adapted to make contact with at least a portion of a foot of the user;

a shaft, connected to the trolley, the shaft having a first end and a second end;

a flexible mechanism comprising a portion of the shaft, for allowing at least one portion of the shaft to move and rotate in one of a plurality of motions and angles, wherein the trolley is pulled along the shaft by the least one foot locking device while the user is in a seated position; and a substantially planar surface with a top surface connected to the second end of the shaft for seating the user in the seated position.

2. The device of claim 1, wherein:

the trolley structure is connected to the shaft by coupling means, the least two vertical plates are positioned parallel to the shaft, the at least three wheels are connected to the at least two vertical plates, the at least three wheels span the shaft for rolling along the shaft, and the shaft is adapted with a plurality of openings to insert a locking pin allowing the trolley structure to start from a plurality of positions along the shaft.

3. The device of claim 1, further including:

a plurality of weights, and at least one trolley weight shield connected to each of the at least two vertical plates, wherein the at least one trolley weight shield adapted for receiving the plurality of weights.

4. The device of claim 1, further including:

at least one alternative wheel, and a housing apparatus connected substantially perpendicular to the first end of the shaft, wherein the housing apparatus having at least one end for receiving and housing the at least one alternative wheel, and the at least one alternative wheel connected to the housing apparatus for allowing the shaft to move and rotate in one of the plurality of motions and angles.

5. The device of claim 1, further including at least one connection device for connecting the flexible mechanism to the first end and the second end of the shaft, wherein the at least one connection device is at least one of a pin, lock, clipping device, spring, bolt, screw, and plug.

6. The device of claim 1, wherein the substantially planar surface includes:

an opening for holding onto the substantial planar surface, a top surface, the top surface adapted for the user to sit in the seated position on the substantially horizontal surface, and a bottom surface, the bottom surface connecting to the shaft.

7. The device of claim 1, wherein the flexible mechanism includes an upper tubing connected to the second end of the shaft and a lower tubing connecting the first end of the shaft to the first end of the shaft.

8. The device of claim 1, further including a flexible mechanism protective cover for covering the flexible mechanism.

9. An exercise device, comprising:

a trolley;

at least one foot locking device connected to the trolley, the at least one foot locking device making contact with at least a portion of a foot of the user;

a shaft, connected to the trolley, having a first end and a second end;

a flexible mechanism comprising a portion of the shaft, for allowing at least one portion of the shaft to move and rotate in one of a plurality of motions and angles, wherein the trolley is pulled along the shaft by the least one foot locking device while the user is in a seated position;

a substantially planar surface with a top surface connected to the second end of the shaft for seating the user in the seated position.

10. The device of claim 9, wherein the trolley further includes:

at least two vertical plates with a first and a second side, at least three wheels with a first and a second end, the first and the second end of the at least three wheels being connected to the at least two vertical plates, wherein:

the trolley structure is connected to the shaft by coupling means, the least two vertical plates are positioned parallel to the shaft, the at least three wheels are connected to the at least two vertical plates, the at least three wheels span the shaft for rolling along the shaft, and the shaft is adapted with a plurality of openings to insert a locking pin allowing the trolley structure to start from a plurality of positions along the shaft.

11. The device of claim 9, further including:

a plurality of weights, and at least one trolley weight shield connected to each of the at least two vertical plates, wherein the at least one trolley weight shield adapted for receiving the plurality of weights.

12. The device of claim 9, further including:

at least one alternative wheel, and a housing apparatus connected substantially perpendicular to the first end of the shaft, wherein the housing apparatus having at least one end for receiving and housing the at least one alternative wheel, and the at least one alternative wheel connected to the housing apparatus for allowing the shaft to move and rotate in one of the plurality of motions and angles.

13. The device of claim 9, further including at least one connection device for connecting the flexible mechanism to the first end and the second end of the shaft, wherein the at least one connection device is at least one of a pin, lock, clipping device, spring, bolt, screw, and plug.

14. The device of claim 9, wherein the substantially planar surface includes:

an opening for holding onto the substantial planar surface, a top surface, the top surface adapted for the user to sit in the seated position on the substantially horizontal surface, and a bottom surface, the bottom surface connecting to the shaft.

15. The device of claim 9, wherein the flexible mechanism includes an upper tubing connected to the second end of the shaft and a lower tubing connecting the first end of the shaft to the first end of the shaft.

16. The device of claim 9, wherein the at least one collapsible beam is adapted with a center joint to return the angled shaft to one of the angled position and one of the collapsed position, the at least one collapsible beam is adapted with a locking slider device to prevent the collapsible bar form collapsing.

17. The device of claim 9, further including a flexible mechanism protective cover for covering the flexible mechanism.

18. A method of manufacturing a device for exercising, comprising:

providing a trolley adapted to be pulled towards a user while the user is in a seated position, the trolley comprising:

at least two vertical plates with a first and a second side, at least three wheels with a first and a second end, the first and the second end of the at least three wheels being connected to the at least two vertical plates, and at least one foot locking device connected to the trolley, the at least one foot locking device adapted to make contact with at least a portion of a foot of the user;

providing a shaft having a first end and a second end, providing a flexible mechanism comprising a portion of the shaft placed in one of a plurality of positions of the shaft between the first end and the second end for allowing at least one portion of the shaft to move and rotate in one of a plurality of motions and angles, the shaft adapted for accommodating the trolley; wherein the trolley is adapted to be pulled along the shaft by the least one foot locking device while the user is in a seated position; and providing a substantially planar surface with a top surface connected to the second end of the shaft for seating the user in the seated position.

* * * * *